US005628207A

United States Patent [19]

Howard et al.

[11] Patent Number: 5,628,207

[45] Date of Patent: May 13, 1997

[54] CRYOGENIC RECTIFICATION SYSTEM FOR PRODUCING LOWER PURITY GASEOUS OXYGEN AND HIGH PURITY OXYGEN

[75] Inventors: Henry E. Howard; Dante P. Bonaquist, both of Grand Island, N.Y.

[73] Assignee: Praxair Technology, Inc., Danbury, Conn.

[21] Appl. No.: 628,370

[22] Filed: Apr. 5, 1996

[51] Int. Cl.[6] ..... F25J 3/00

[52] U.S. Cl. ..... 62/646; 62/654

[58] Field of Search ..... 62/646, 654

[56] References Cited

U.S. PATENT DOCUMENTS

| | | | |
|---|---|---|---|
| 4,433,989 | 2/1984 | Erickson | 62/13 |
| 4,464,191 | 8/1984 | Erickson | 62/31 |
| 4,604,116 | 8/1986 | Erickson | 62/13 |
| 4,704,148 | 11/1987 | Kleinberg | 62/24 |
| 4,824,453 | 4/1989 | Rottmann et al. | 62/22 |
| 4,977,746 | 12/1990 | Grenier et al. | 62/22 |
| 5,291,737 | 3/1994 | Camberlein et al. | 62/22 |
| 5,337,570 | 8/1994 | Prosser | 62/646 |
| 5,438,835 | 8/1995 | Rathbone | 62/646 |
| 5,454,227 | 10/1995 | Straub et al. | 62/654 |
| 5,463,871 | 11/1995 | Cheung | 62/38 |

*Primary Examiner*—Ronald C. Capossela
*Attorney, Agent, or Firm*—Stanley Ktorides

[57] ABSTRACT

A cryogenic rectification system for producing lower purity gaseous oxygen and high purity oxygen employing a double column and an auxiliary column which upgrades lower pressure column bottom liquid or processes higher pressure column kettle liquid.

15 Claims, 2 Drawing Sheets

CRYOGENIC RECTIFICATION SYSTEM FOR PRODUCING LOWER PURITY GASEOUS OXYGEN AND HIGH PURITY OXYGEN

TECHNICAL FIELD

This invention relates generally to the cryogenic rectification of feed air and, more particularly, to the cryogenic rectification of feed air to produce oxygen.

BACKGROUND ART

The demand for lower purity oxygen is increasing in applications such as glassmaking, steelmaking and energy production. Lower purity oxygen is generally produced in large quantities by the cryogenic rectification of feed air in a double column wherein feed air at the pressure of the higher pressure column is used to reboil the liquid bottoms of the lower pressure column and is then passed into the higher pressure column.

Some users of lower purity oxygen, for example integrated steel mills, often require some high purity oxygen in addition to lower purity gaseous oxygen. Such dual purity production cannot be efficiently accomplished with a conventional lower purity oxygen plant.

Accordingly, it is an object of this invention to provide a cryogenic rectification system which can effectively and efficiently produce both lower purity gaseous oxygen and high purity oxygen.

SUMMARY OF THE INVENTION

The above and other objects, which will become apparent to one skilled in the art upon a reading of this disclosure, are attained by the present invention, one aspect of which is:

A cryogenic rectification method for the production of lower purity gaseous oxygen and high purity oxygen comprising:

(A) passing feed air into a higher pressure column and separating the feed air within the higher pressure column by cryogenic rectification into oxygen-enriched liquid and into nitrogen-enriched fluid;

(B) passing oxygen-enriched liquid and a first portion of the nitrogen-enriched fluid into a lower pressure column and producing oxygen-richer liquid within the lower pressure column;

(C) passing oxygen-richer liquid from the lower pressure column into an auxiliary column and producing further oxygen-richer liquid within the auxiliary column;

(D) at least partially vaporizing the further oxygen-richer liquid by indirect heat exchange with a second portion of the nitrogen-enriched fluid and producing lower purity gaseous oxygen and high purity oxygen within the auxiliary column; and (E) recovering lower purity gaseous oxygen and high purity oxygen from the auxiliary column.

Another aspect of the invention is:

A cryogenic rectification apparatus for the production of lower purity gaseous oxygen and high purity oxygen comprising:

(A) a double column comprising a first column and a second column and means for passing feed air into the first column;

(B) an auxiliary column comprising a reboiler and means for passing fluid from the upper portion of the first column into the reboiler;

(C) means for passing fluid from the first column into the second column;

(D) means for passing fluid from the lower portion of the second column into the auxiliary column; and (E) means for recovering product from the upper portion and means for recovering product from the lower portion of the auxiliary column.

A further aspect of the invention is:

A cryogenic rectification method for the production of lower purity gaseous oxygen and high purity oxygen comprising:

(A) passing feed air into a higher pressure column and separating the feed air within the higher pressure column by cryogenic rectification into oxygen-enriched liquid and into nitrogen-enriched fluid;

(B) passing nitrogen-enriched fluid and a first portion of the oxygen-enriched liquid into a lower pressure column and producing lower purity gaseous oxygen within the lower pressure column;

(C) passing a second portion of the oxygen-enriched liquid from the higher pressure column into an auxiliary column and producing high purity oxygen within the auxiliary column;

(D) recovering lower purity gaseous oxygen from the lower pressure column; and (E) recovering high purity oxygen from the auxiliary column.

Yet another aspect of the invention is:

A cryogenic rectification apparatus for the production of lower purity gaseous oxygen and high purity oxygen comprising:

(A) a double column comprising a first column and a second column and means for passing feed air into the first column;

(B) an auxiliary column and means for passing fluid from the lower portion of the first column into the auxiliary column;

(C) means for passing fluid from the first column into the second column;

(D) means for recovering product from the second column; and (E) means for recovering product from the auxiliary column.

Still another aspect of the invention is:

A cryogenic rectification method for the production of lower purity gaseous oxygen and high purity oxygen comprising:

(A) passing feed air into a higher pressure column and separating the feed air within the higher pressure column by cryogenic rectification into oxygen-enriched liquid and into nitrogen-enriched fluid;

(B) passing oxygen-enriched liquid and nitrogen-enriched fluid into a lower pressure column and producing oxygen-richer liquid within the lower pressure column;

(C) passing oxygen-richer liquid from the lower pressure column into an auxiliary column operating at a pressure greater than that of the lower pressure column, and producing further oxygen-richer liquid within the auxiliary column;

(D) at least partially vaporizing the further oxygen-richer liquid and producing lower purity gaseous oxygen and high purity oxygen within the auxiliary column; and (E) recovering lower purity gaseous oxygen and high purity oxygen from the auxiliary column.

As used herein, the term "feed air" means a mixture comprising primarily oxygen and nitrogen, such as ambient air.

As used herein, the term "lower purity gaseous oxygen" means a gas having an oxygen concentration with the range of from 50 to 99 mole percent.

As used herein, the term "high purity oxygen" means a fluid having an oxygen concentration equal to or greater than 99.5 mole percent.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.* The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein the term "reboiler" means a heat exchange device which generates column upflow vapor from column liquid.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "recovered" means passed out of the system, i.e. actually recovered, in whole or in part, or otherwise removed from the system.

DETAILED DESCRIPTION

The invention will be described in detail with reference to the Drawings.

Figure 1:
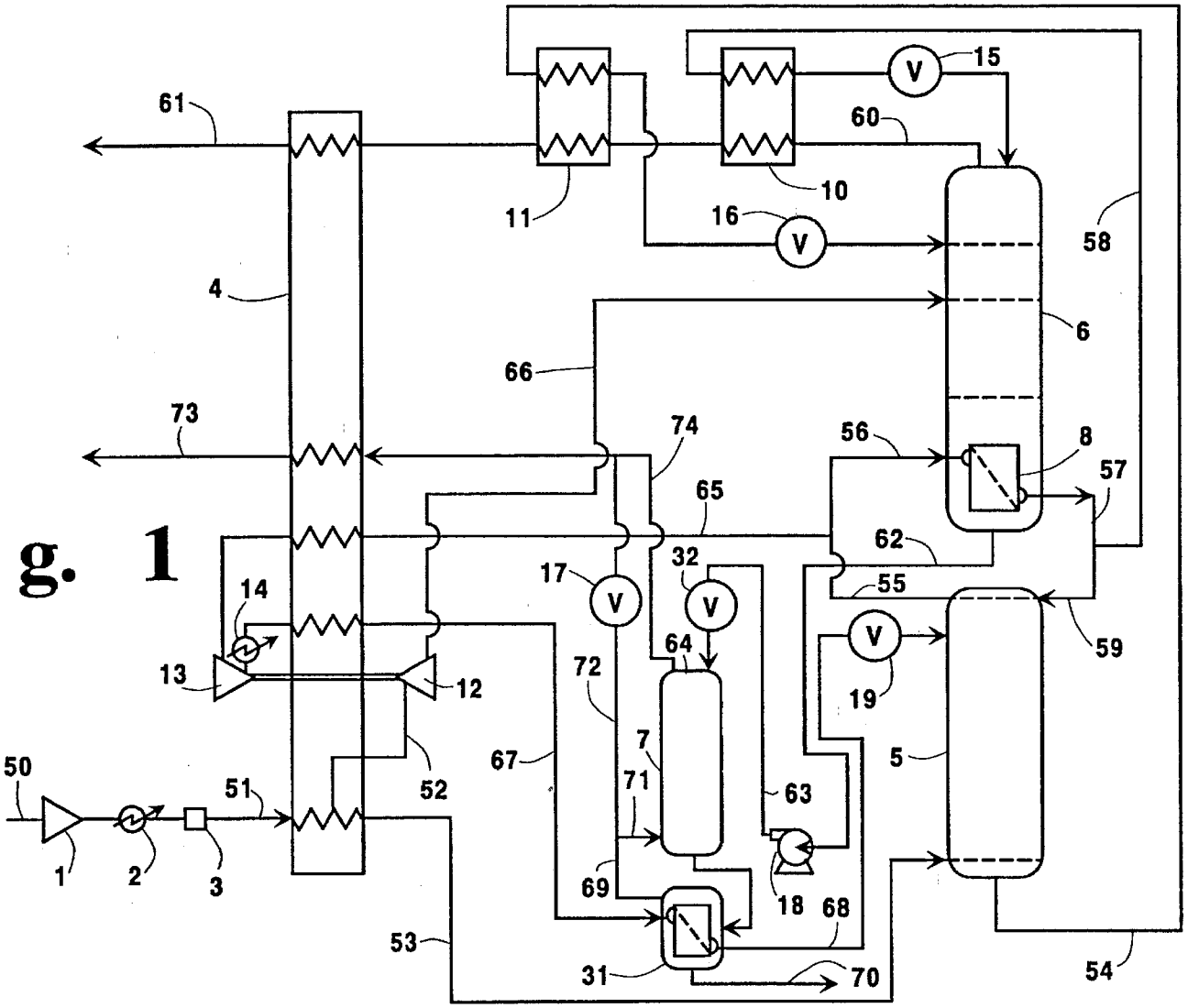
FIG. 1 is a schematic representation of one preferred embodiment of the invention.

Referring now to FIG. 1, feed air 50 is compressed to a pressure within the range of from 55 to 250 pounds per square inch absolute (psia) by passage through compressor 1, is cooled of the heat of compression in cooler 2, and is cleaned of high boiling impurities, such as water vapor and carbon dioxide, by passage through purifier 3. Resulting feed air stream 51 is passed into main heat exchanger 4 wherein it is cooled by indirect heat exchange against return streams. A portion 52 of the feed air is withdrawn after partial traverse of main heat exchanger 4, turboexpanded by passage through turboexpander 12 to generate refrigeration and then passed as stream 66 into lower pressure column 6. The major portion 53 of the feed air completely traverses main heat exchanger 4 and is then passed into higher pressure column 5.

Higher pressure or first column 5 is the higher pressure column of a double column which also includes lower pressure or second column 6. Higher pressure column 5 is operating at a pressure within the range of from 50 to 250 psia. Within higher pressure column 5 the feed air is separated by cryogenic rectification into oxygen-enriched liquid and nitrogen-enriched fluid. Oxygen-enriched liquid is withdrawn from the lower portion of higher pressure column 5 as stream 54, subcooled by passage through subcooler 11, and passed through valve 16 and into lower pressure column 6 which is operating at a pressure less than that of higher pressure column 5 and within the range of from 15 to 85 psia.

Nitrogen-enriched fluid is withdrawn from the upper portion of higher pressure column 5 as vapor stream 55. Some of vapor stream 55 is passed as stream 56 into main condenser 8 wherein it is condensed against reboiling lower pressure column 6 bottom liquid. Resulting liquid 57 is withdrawn from main condenser 8 and a first portion 58 of the nitrogen-enriched fluid is subcooled by passage through subcooler 10 and then passed through valve 15 and into lower pressure column 6 as reflux. Some of liquid 57 is passed as stream 59 into higher pressure column 5 as reflux.

Within lower pressure column 6 the various feeds are separated by cryogenic rectification into nitrogen-richer vapor and oxygen-richer liquid. Nitrogen-richer vapor is withdrawn from the upper portion of lower pressure column 6 as stream 60, warmed by passage through subcoolers 10 and 11 and main heat exchanger 4, and removed as stream 61 which may be recovered. Oxygen-richer liquid is withdrawn from the lower portion of lower pressure column 6 as stream 62, and pumped to a higher pressure within the range of from 25 to 285 psia by passage through liquid pump 18. Resulting pressurized stream 63 is passed through valve 32 and into auxiliary column 64 which comprises column section 7 and reboiler 31.

Auxiliary column 64 is operating at a pressure of from 10 to 200 pounds per square inch (psi) greater than that of lower pressure column 6. Preferably auxiliary column 64 operates at a pressure at least 30 psi, most preferably at least 60 psi, greater than that of lower pressure column 6. The oxygen-richer liquid flows down auxiliary column 64 against upflowing vapor and becomes progressively richer in oxygen, forming further oxygen-richer liquid which collects in reboiler 31.

A second portion 65 of the nitrogen-enriched fluid is taken from stream 55, warmed by passage through main heat exchanger 4 and compressed by passage through compressor 13. Preferably, as illustrated in FIG. 1, compressor 13 is mechanically linked or coupled to turboexpander 12. The resulting compressed stream is cooled of the heat of compression in cooler 14, further cooled by passage through main heat exchanger 4 and then passed as stream 67 to reboiler 31 wherein by indirect heat exchange it serves to at least partially vaporize the further oxygen-richer liquid. Resulting nitrogen-enriched fluid stream 68 is passed from reboiler 31 through valve 19 and into higher pressure column 5.

Resulting gas and remaining liquid are withdrawn from reboiler 31 as streams 69 and 70 respectively. In the embodiment illustrated in FIG. 1 stream 70 is recovered as high purity liquid oxygen product oxygen. High purity oxygen may also be recovered from the auxiliary column as vapor in addition to or in place of the high purity liquid oxygen. The major portion 71 of stream 69 is passed into column section 7 to serve as the upflowing vapor. To enable better control of the operation of the auxiliary column, a minor portion 72 of stream 69 is passed through valve 17 and main heat exchanger 4. Upflowing vapor is withdrawn from the upper portion of auxiliary column section 7 as stream 74, passed through main heat exchanger 4, and recovered in stream 73 as lower purity gaseous oxygen product. If desired, as illustrated in FIG. 1, stream 72 may be added to stream 74 and recovered in product stream 73.

In an alternative embodiment, reboiler 31 may be driven by a portion of the feed air. In this embodiment a portion of feed air stream 51 is further compressed and passed into reboiler 31 wherein it is at least partially condensed and wherein, by indirect heat exchange, it serves to at least partially vaporize the further oxygen-richer liquid. The resulting feed air is then passed from reboiler 31 into higher pressure column 5 wherein it undergoes the aforesaid separation along with the other portion of the feed air passed into the higher pressure column.

Figure 2:
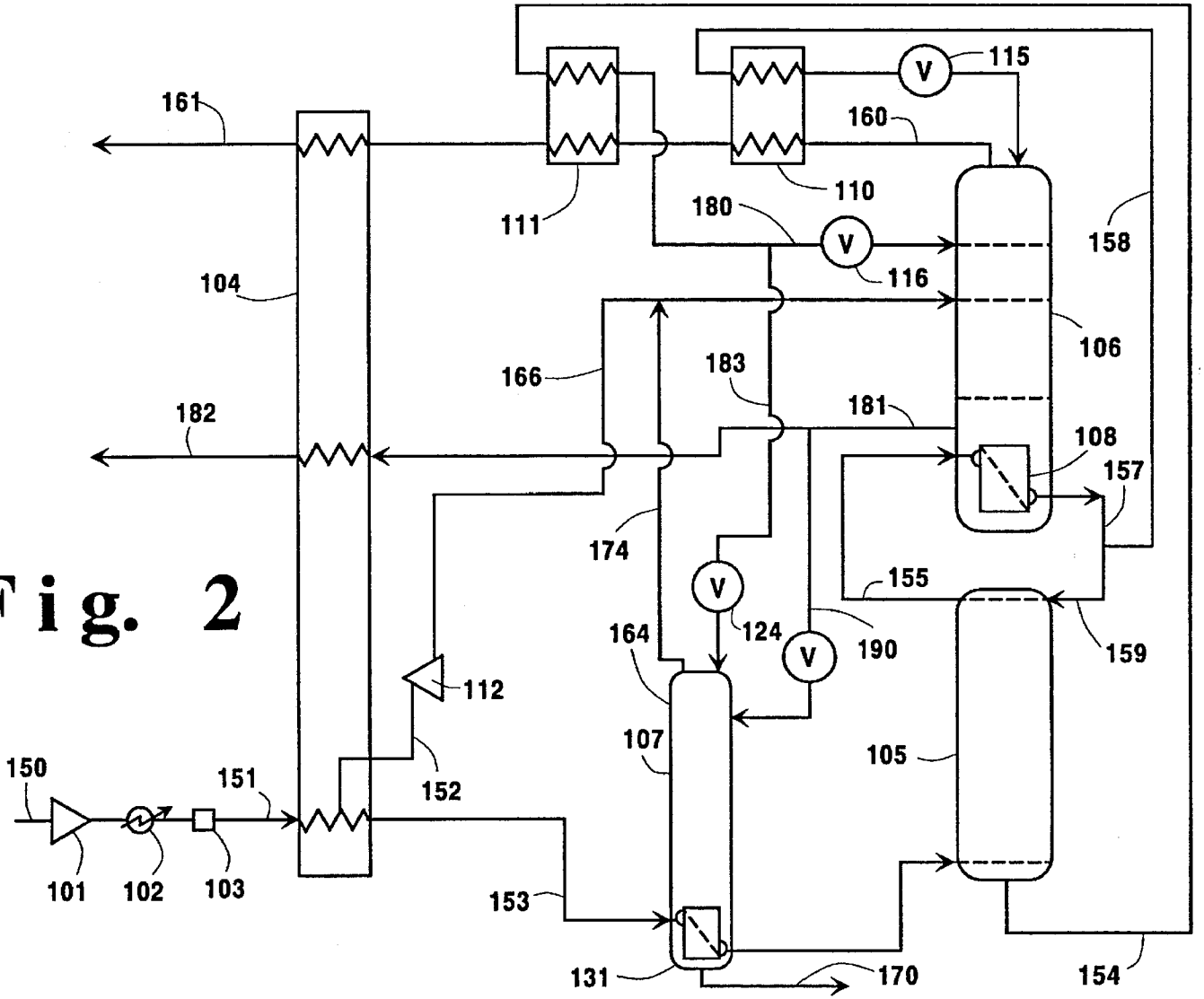
FIG. 2 is a schematic representation of another preferred embodiment of the invention.

FIG. 2 illustrates another embodiment of the invention wherein the lower purity gaseous oxygen product is recovered from the lower pressure column and the auxiliary column reboiler is driven by feed air.

Referring now to FIG. 2, feed air 150 is compressed to a pressure within the range of from 50 to 250 psia by passage through compressor 101, is cooled of the heat of compression in cooler 102, and is cleaned of high boiling impurities, such as water vapor and carbon dioxide, by passage through purifier 103. Resulting feed air stream 151 is passed into main heat exchanger 104 wherein it is cooled by indirect heat exchange against return streams. A portion 152 of the feed air is withdrawn after partial traverse of main heat exchanger 104, turboexpanded by passage through turboexpander 112 to generate refrigeration and then passed as stream 166 into lower pressure column 106. The major portion 153 of the feed air completely traverses main heat exchanger 104 and is then passed through reboiler 131 and into higher pressure column 105.

Higher pressure or first column 105 is the higher pressure column of a double column which also includes lower pressure or second column 106. Higher pressure column 105 is operating at a pressure within the range of from 50 to 250 psia. Within higher pressure column 105 the feed air is separated by cryogenic rectification into oxygen-enriched liquid and nitrogen-enriched fluid. Oxygen-enriched liquid is withdrawn from the lower portion of higher pressure column 105 as stream 154 and subcooled by passage through subcooler 111. A first portion 180 of the oxygen-enriched liquid is passed through valve 116 and into lower pressure column 106 which is operating at a pressure less than that of higher pressure column 105 and within the range of from 15 to 85 psia.

Nitrogen-enriched fluid is withdrawn from the upper portion of higher pressure column 105 as vapor stream 155 and passed into main condenser 108 wherein it is condensed against reboiling lower pressure column 106 bottom liquid. Resulting liquid 157 is withdrawn from main condenser 108 and a first portion 158 of the nitrogen-enriched fluid is subcooled by passage through subcooler 110 and then passed through valve 115 and into lower pressure column 106 as reflux. Some of liquid 157 is passed as stream 159 into higher pressure column 105 as reflux.

Within lower pressure column 106 the various feeds are separated by cryogenic rectification into nitrogen-richer vapor and oxygen-richer liquid. Nitrogen-richer vapor is withdrawn from the upper portion of lower pressure column 106 as stream 160, warmed by passage through subcoolers 110 and 111 and main heat exchanger 104 and removed as stream 161 which may be recovered.

Oxygen-richer liquid is reboiled in main condenser 108 by indirect heat exchange with condensing nitrogen-enriched vapor to produce lower purity gaseous oxygen. Lower purity gaseous oxygen is withdrawn from lower pressure column 106 as stream 181, warmed by passage through main heat exchanger 104, and recovered in stream 182 as lower purity gaseous oxygen product.

A second portion of the oxygen-enriched liquid is passed as stream 183 through valve 124 into auxiliary column 164 which comprises column section 107 and reboiler 131. If desired, some lower purity gaseous oxygen, such as is illustrated by stream 190, may be passed from lower pressure column 106 into auxiliary column 164. Auxiliary column 164 is operating at a pressure within the range of from 15 to 85 psia. The oxygen-enriched liquid flows down auxiliary column 164 against upflowing vapor and becomes progressively richer in oxygen, forming further oxygen-richer liquid which collects in reboiler 131 and is at least partially vaporized by indirect heat exchange with feed air stream 153 as was previously described. Resulting gas serves as the upflowing vapor for auxiliary column 164 and is withdrawn from auxiliary column section 107 as stream 174 which preferably is combined with stream 166 and passed into lower pressure column 106. In the embodiment of the invention illustrated in FIG. 2, remaining liquid is withdrawn from auxiliary column reboiler 131 as stream 170 and recovered as high purity liquid oxygen product. High purity oxygen may also be recovered from auxiliary column 164 in vapor form in addition to or in place of the high purity liquid oxygen.

Although the invention has been described in detail with reference to certain preferred embodiments, those skilled in the art will recognize that there are other embodiments of the invention within the spirit and the scope of the claims.

We claim:

1. A cryogenic rectification method for the production of lower purity gaseous oxygen and high purity oxygen comprising:

(A) passing feed air into a higher pressure column and separating the feed air within the higher pressure column by cryogenic rectification into oxygen-enriched liquid and into nitrogen-enriched fluid;

(B) passing oxygen-enriched liquid and a first portion of the nitrogen-enriched fluid into a lower pressure column and producing oxygen-richer liquid within the lower pressure column;

(C) passing oxygen-richer liquid from the lower pressure column into an auxiliary column and producing further oxygen-richer liquid within the auxiliary column;

(D) at least partially vaporizing the further oxygen-richer liquid by indirect heat exchange with a second portion of the nitrogen-enriched fluid and producing lower purity gaseous oxygen and high purity oxygen within the auxiliary column; and (E) recovering lower purity gaseous oxygen and high purity oxygen from the auxiliary column.

2. The method of claim 1 further comprising increasing the pressure of the oxygen-richer liquid prior to passing it into the auxiliary column.

3. The method of claim 1 further comprising compressing the second portion of the nitrogen-enriched fluid prior to the indirect heat exchange with the further oxygen-richer liquid.

4. The method of claim 3 further comprising turboexpanding a portion of feed air and passing the turboexpanded feed air into the lower pressure column wherein the turboexpansion of the feed air portion and the compression of the second portion of the nitrogen-enriched fluid are mechanically linked.

5. A cryogenic rectification apparatus for the production of lower purity gaseous oxygen and high purity oxygen comprising:

(A) a double column comprising a first column and a second column and means for passing feed air into the first column;

(B) an auxiliary column comprising a reboiler and means for passing fluid from the upper portion of the first column into the reboiler;

(C) means for passing fluid from the first column into the second column;

(D) means for passing fluid from the lower portion of the second column into the auxiliary column; and (E) means for recovering product from the upper portion and means for recovering product from the lower portion of the auxiliary column.

6. The apparatus of claim 5 wherein the means for passing fluid from the lower portion of the second column into the auxiliary column includes a liquid pump.

7. The apparatus of claim 5 wherein the means for passing fluid from the upper portion of the first column into the bottom reboiler includes a compressor.

8. The apparatus of claim 7 further comprising a turboexpander mechanically coupled to the compressor.

9. A cryogenic rectification method for the production of lower purity gaseous oxygen and high purity oxygen comprising:

(A) passing feed air into a higher pressure column and separating the feed air within the higher pressure column by cryogenic rectification into oxygen-enriched liquid and into nitrogen-enriched fluid;

(B) passing nitrogen-enriched fluid and a first portion of the oxygen-enriched liquid into a lower pressure column and producing lower purity gaseous oxygen within the lower pressure column;

(C) passing a second portion of the oxygen-enriched liquid from the higher pressure column into an auxiliary column and producing higher purity oxygen within the auxiliary column;

(D) recovering lower purity gaseous oxygen from the lower pressure column; and (E) recovering high purity oxygen from the auxiliary column.

10. The method of claim 9 further comprising passing some lower purity gaseous oxygen from the lower pressure column into the auxiliary column.

11. A cryogenic rectification apparatus for the production of lower purity gaseous oxygen and high purity oxygen comprising:

(A) a double column comprising a first column and a second column and means for passing feed air into the first column;

(B) an auxiliary column and means for passing fluid from the lower portion of the first column into the auxiliary column;

(C) means for passing fluid from the first column into the second column;

(D) means for recovering product from the second column; and (E) means for recovering product from the auxiliary column.

12. The apparatus of claim 11 further comprising means for passing fluid from the lower portion of the second column into the auxiliary column.

13. A cryogenic rectification method for the production of lower purity gaseous oxygen and high purity oxygen comprising:

(A) passing feed air into a higher pressure column and separating the feed air within the higher pressure column by cryogenic rectification into oxygen-enriched liquid and into nitrogen-enriched fluid;

(B) passing oxygen-enriched liquid and nitrogen-enriched fluid into a lower pressure column and producing oxygen-richer liquid within the lower pressure column;

(C) passing oxygen-richer liquid from the lower pressure column into an auxiliary column operating at a pressure greater than that of the lower pressure column, and producing further oxygen-richer liquid within the auxiliary column;

(D) at least partially vaporizing the further oxygen-richer liquid and producing lower purity gaseous oxygen and high purity oxygen within the auxiliary column; and (E) recovering lower purity gaseous oxygen and high purity oxygen from the auxiliary column.

14. The method of claim 13 wherein the further oxygen-richer liquid is at least partially vaporized by indirect heat exchange with a portion of the feed air prior to passing said feed air portion in the higher pressure column.

15. The method of claim 13 wherein the further oxygen-richer liquid is at least partially vaporized by indirect heat exchange by a portion of the nitrogen-enriched fluid, said nitrogen-enriched fluid portion thereafter being passed into the higher pressure column.

* * * * *